US006293879B2

(12) United States Patent
Moore

(10) Patent No.: US 6,293,879 B2
(45) Date of Patent: Sep. 25, 2001

(54) MULTI-DISK BOOMERANG

(76) Inventor: Charles D. Moore, 67 Willowood, Aliso Viejo, CA (US) 92656

( * ) Notice: Subject to any disclaimer, the term of this patent is extended or adjusted under 35 U.S.C. 154(b) by 0 days.

(21) Appl. No.: 09/754,560

(22) Filed: Jan. 4, 2001

(51) Int. Cl.[7] ..... A63B 65/08
(52) U.S. Cl. ..... 473/590
(58) Field of Search ..... 473/590, 588, 473/589; 446/34, 36, 46, 47, 48; D21/436, 437, 438, 441, 443, 444

(56) References Cited

U.S. PATENT DOCUMENTS

D. 219,158 * 11/1970 Gray et al. ..... D21/443
D. 241,361 * 9/1976 Crew ..... D21/437
D. 340,480 10/1993 Cummings .
4,222,573 * 9/1980 Adler ..... 473/590
4,452,461 6/1984 O'Brien .
4,772,030 * 9/1988 Hunt ..... 473/590
5,490,678 2/1996 Darnell ..... 473/590

* cited by examiner

*Primary Examiner*—Steven Wong

(57) ABSTRACT

A flying toy of the boomerang type utilizing circular airfoils in the form of disks comprising a main disk (10) with a plurality of control disks (12) or (36) affixed to its perimeter at their perimeters, sufficient to provide rigidity and lying in a generally common plane forming a homogeneous one-piece unit. When thrown overhand so as to rotate through the air the combination of disks creates lift throughout 360° of boomerang's rotation. The result is a safer, more balanced and stable boomerang that is easy to throw and catch. The specific arrangement of disks provides a profile suggestive of and suitable for application of a variety of cartoon faces such as mice, dogs or bears making a desirable wall hanging when not in use.

3 Claims, 2 Drawing Sheets

28

2
ROTATION
32
12
12
2
10

20
26
24
34
22
SPHERICAL
RADIUS
16
SPHERICAL
RADIUS
30
18
14

MULTI-DISK BOOMERANG

BACKGROUND—FIELD OF INVENTION

This invention relates to boomerangs, an aerodynamic shaped implement that when thrown into the air, with a degree of skill, will return to the person throwing it.

BACKGROUND—DESCRIPTION OF PRIOR ART

Most boomerangs are patterned after the ancient aboriginal boomerang that was used as a weapon. See *The World Book Encyclopedia*, 1997 edition. These boomerangs have a bend, called an elbow, near the middle, that forms two wings shaped like airplane wings. This type of boomerang, because of its far flying capability, is still favored for outdoor use. The shape and rotational speed make this type nearly impossible to catch and poses a risk of injury to bystanders. Manufacturers of this type often place warning labels on them. If one were hit in the head or eye most prior art boomerangs could inflict serious injury. Because of this hazard crowded areas must be avoided and younger children can't participate in the sport.

There are a variety of modern toy or sport boomerangs ranging from small, indoor types made of foam to larger, outdoor types made of wood or plastic. All of these boomerangs have from two to five wings or rotor blades connected at a center point. Since boomerangs must rotate as they fly, to produce stability and the gyroscopic precession which cause them to return, these wings must be considered more like the rotor blades of a helicopter.

A rotor blade consists of an upper and lower surface which are essentially parallel with respect to one another along a center line drawn from wing root to wing tip. The lower surface is essentially flat and the upper surface arched from leading edge to trailing edge, forming an airfoil along the length of the blade. With this type of boomerang the rotor blades fly and the central hub is only a means for holding the blades in position.

The prior art continues to reinvent the rotor blade. Many have enlarged or bulbous ends where the weight is concentrated at the tip of the blades in an effort to prolong the duration of the boomerang's axial rotation. The elongated blades and greater tip speed, however, produce more drag which defeats this purpose. This is especially so where more than three blades are utilized since each blade must pass through the more disturbed air of the preceding blade. More than three blades only adds redundancy and unnecessary weight to a flying implement the size of a boomerang.

One disadvantage with this type of boomerang is that a wing or rotor blade airfoil produces maximum lift when the advancing blade rotates to a position where its leading edge is approximately perpendicular to the relative wind. When blade rotates to a position where the centerline heads to the wind no lift is produced and as it rotates further and becomes the retreating blade, depending on the forward speed, little or no lift is produced. Lift is mainly produced in one quadrant of boomerang's rotation and is unevenly distributed over boomerang's surface. Therefore, this type of boomerang is inherently unstable and relies on centrifugal force produced by the rotational speed to maintain stability. Another disadvantage with this type of boomerang is that a very precise flick of the wrist is required to match rotational speed to forward speed to accomplish this. If rotational speed slow beyond a certain RPM boomerang's flight path becomes erratic.

These boomerangs have no particular aesthetic appeal which would make an interesting child's wall hanging when not in use.

OBJECTS AND ADVANTAGES

Accordingly, several objects and advantages of the invention are:

1. to provide a safer boomerang so that crowded areas need not be avoided and younger children may participate.
   The present invention solves the safety problem of the bladed type boomerang by providing a more compact boomerang with a small radius of gyration which produces a slower tip speed. This, combined with the more rounded contours, presents little or no danger to bystanders.
2. to provide a boomerang that is easier to throw and catch.
   The unique circular or circular and elliptical combination of airfoils produce a continuous and more uniform lift throughout 360° of boomerang's rotation, the result being better balance, stability, and greater ease of operation.
3. to provide a boomerang with larger market appeal.
   In addition to the ease of operation and safety features The specific shape of the invention provides an ideal surface for application of a variety of cartoon faces with ears which make it desirable as a child's wall hanging.

Further objects and advantages of my invention will become apparent from a consideration of the drawings and ensuing description.

DRAWING FIGURES

REFERENCE NUMERALS IN DRAWINGS

| Number | Nomenclature |
|---|---|
| 10 | Main Disk/Face |
| 12 | Control Disk/Ear |
| 14 | Airfoil thickness of Main Disk/Face |
| 16 | Convex front surface of Main Disk/Face |
| 18 | Radiused perimeter of Main Disk/Face |
| 20 | Airfoil thickness of Control Disk/Ear |
| 22 | Convex front surface of Control Disks/Ears |
| 24 | Radiused perimeter of Control Disks/Ears |
| 26 | Angle of dihedral |
| 28 | Angle of attack |
| 30 | Recess in rear surface for weight reduction |
| 32 | Center of mass and rotation |
| 34 | Nose (optional) |
| 36 | Elliptical Control Disk/Ear |
| 38 | Length of elliptical Control Disk/Ear |
| 40 | Width of elliptical Control Disk/Ear |

SUMMARY

A Boomerang utilizing multiple airfoils in the form of disks comprising a main disk with a plurality of control disks affixed to its perimeter at their perimeters which orbit and control boomerang's flight path.

DESCRIPTION OF INVENTION

Figures 1, 2, 3:
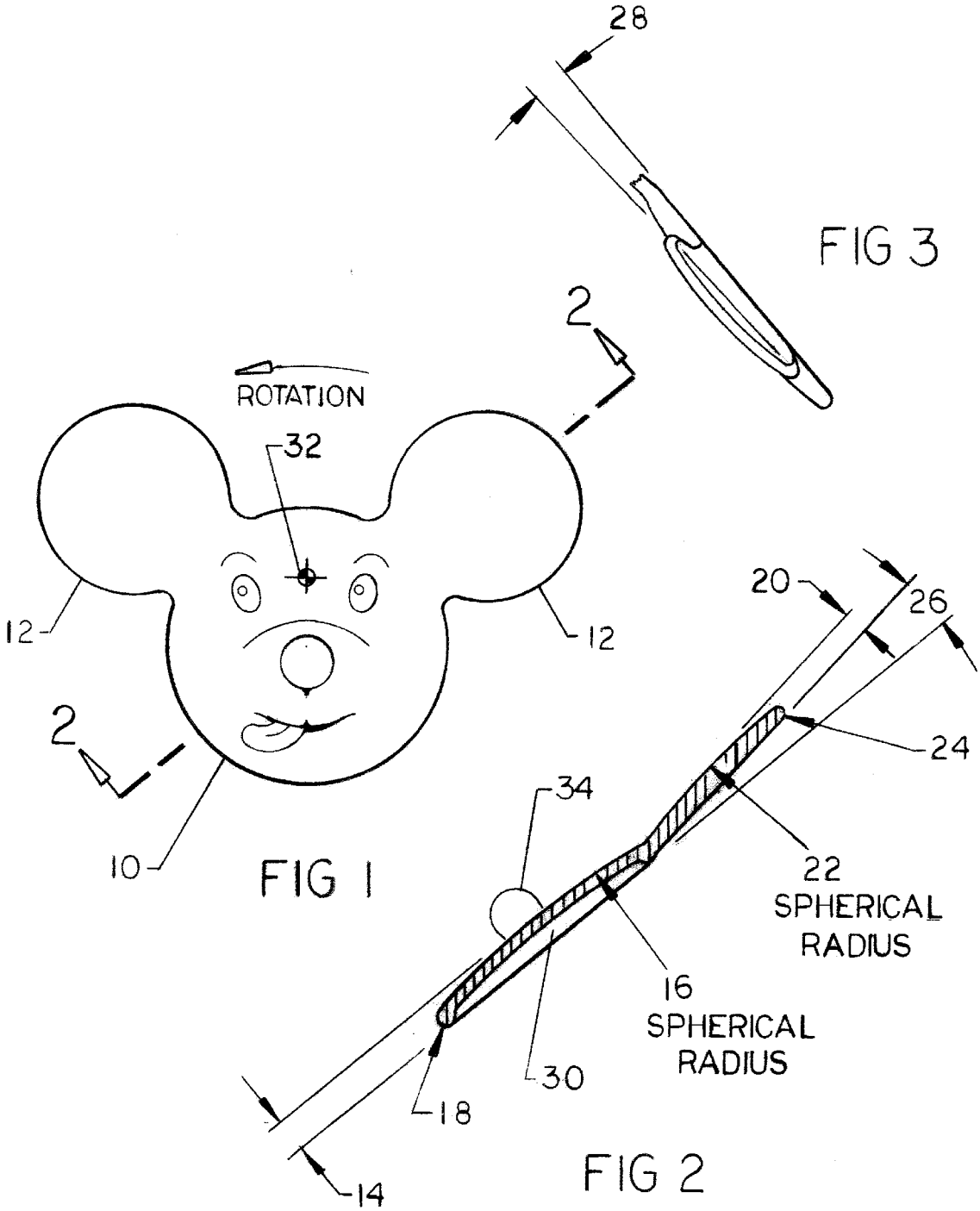
FIG. 1 is a front view showing overall arrangement of one preferred embodiment of the invention.
FIG. 2 is a view in detail of the portion indicated by section lines 2—2 in FIG. 1.
FIG. 3 is a view showing angle of attack of control disks/ears.

A typical embodiment of the boomerang of the present invention is illustrated in Drawing FIGS. 1 through 3. FIG. 1 shows three essentially round disks, a Main Disk/Face 10 and two Control Disks/Ears 12. Control Disks 12 are asymmetrically located on and affixed to the perimeter of Main Disk 10 sufficient to provide rigidity approximately 100° apart, forming a homogeneous one-piece structure. Main Disk 10, having a diameter approximately one-third greater than Control Disk 12, is substantially larger. The surface area of Main Disk 10 is approximately equal to the combined surface area of Control Disks 12. Center of mass and center of rotation is indicated by 32.

Drawing FIG. 2 shows contours and airfoil of Main Disk 10 and Control Disks 12. A Radius 18 forms the perimeter of Main Disk 10. A spherical Radius 16 forms a 360° convex front surface of Main Disk 10. A thickness and height of airfoil is indicated by Dimension 14; approximately 12% of disk diameter is recommended. A Nose 34 is shown but it is optional and has little effect on flight. A Recess 30 may be added to rear surface of Main Disk 10 for weight reduction when constructed of heavier materials such as thermoplastics. Rear surface of Control Disks 12 may be recessed for the same purpose.

Except for size, Control Disks 12 are similar to Main Disk 10. A Radius 24 forms the perimeter of both Control Disks 12. A spherical radius 22 forms a 360° convex front surface of Control Disks 12. A thickness of Control Disks 12 and height of airfoil is indicated by Dimension 20; approximately 12% of disk diameter is recommended. All three disks have a circular airfoil that will create lift at any degree of rotation to the wind. Plane of Control Disks 12 may be given a dihedral Angle 26 with respect to plane of Main Disk 10. A corresponding Angle of Attack 28 is shown in FIG. 3. As with any flying device, size, weight, airfoil and angles of dihedral and attack are interrelated and variable. An airfoil, by virtue of its contours, has a built-in geometric angle of attack. In a lightweight boomerang with a thicker, high-lift airfoil, Angles 26 and 28 may not be required whereas a boomerang of heavier material and a thinner airfoil may require approximately one to four degrees of said angle depending on desired flight path. Angle 26 and Angle 28 can be set when manufactured or, depending on material used, can be tuned in the field. The art of tuning is well known to those experienced in the art of boomerangs. The boomerang shown in FIGS. 1 through 3 is a right-handed boomerang. A left-handed boomerang is identical except Angle 28, if required, is reversed.

Figure 4:
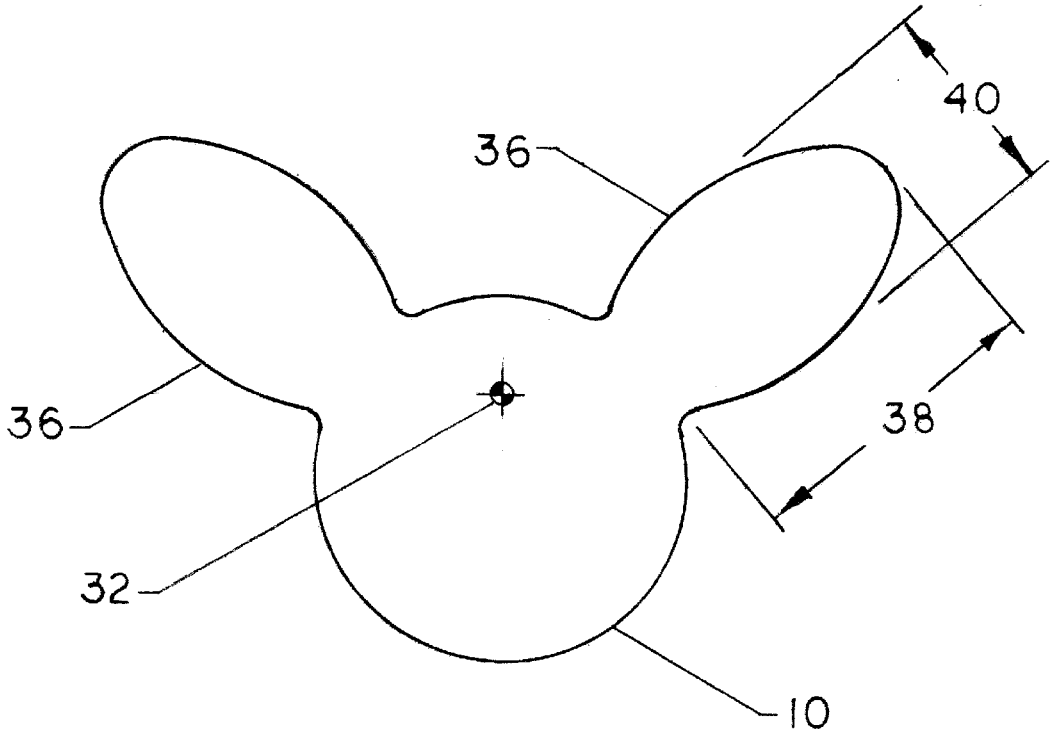
FIG. 4 is a front view of a second embodiment which is a modification of embodiment shown in FIG. 1 with control disks/ears made elliptical.
Figure 5:
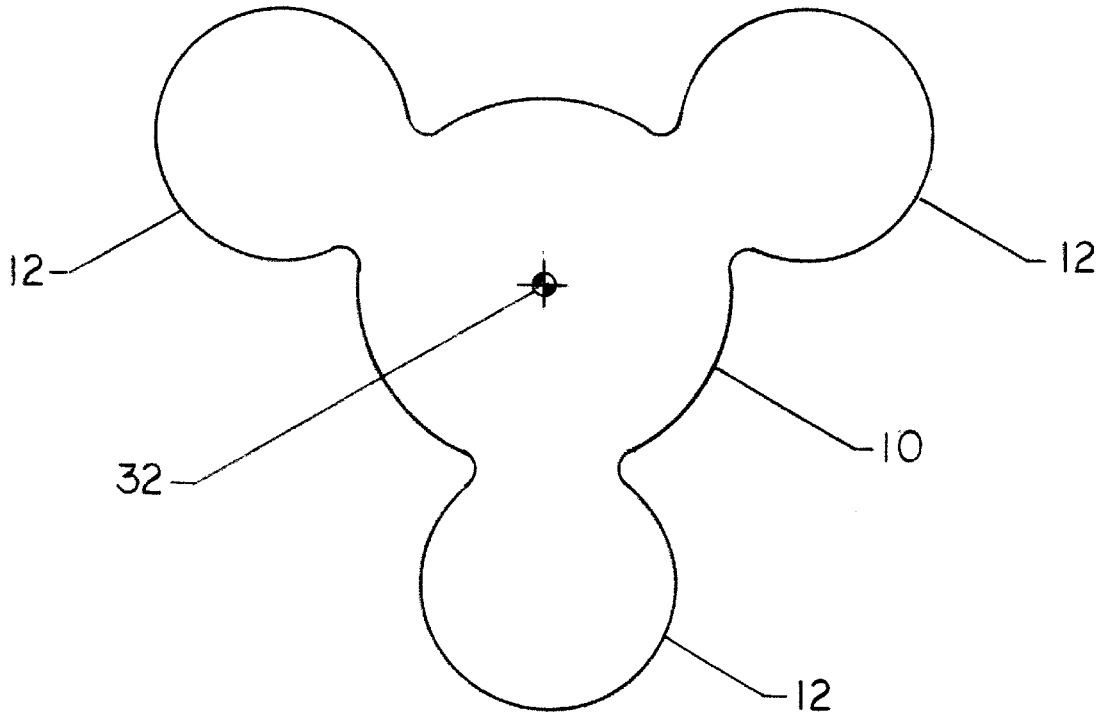
FIG. 5 is a front view of a third embodiment, with a third control disk affixed to the perimeter of the main disk.

Additional embodiments are shown in FIGS. 4 and 5. FIG. 4 shows a second embodiment of the invention. This embodiment is identical to the embodiment shown in FIGS. 1 through 3 with one exception—elliptical Control Disks 36 are substituted for round Control Disks 12. The Length 38 of Control Disc 36 is approximately 150% of Width 40. The entire front surface of Control Disk 36 is convex, giving it an elliptical airfoil which produces lift at any degree of rotation to relative wind.

FIG. 5. shows a third embodiment of the invention. In this embodiment three Control Disks 12 are equally spaced about the perimeter of Main Disk 10. All shapes, contours of disks described in FIGS. 1 through 3 apply. The new center of rotation 32 makes this embodiment the easiest to catch. A multi-disk boomerang can be any size that is practical to throw or launch.

All three embodiments described share the same disk-type airfoil and theory of aerodynamics and are therefore very closely related and fly equally well. The unique airfoil configuration and combination is an integral part of this invention.

It is intended that most multi-disk boomerangs be produced with cartoon faces similar to but not limited to that which is shown in FIG. 1 and provided with a notch or other means to hang for display.

A multi-disk boomerang can be made of any material that can be carved, molded or otherwise shaped. Smaller, indoor types would probably be made of lighter foamed materials and larger, outdoor versions made of more rigid materials. Existing working models have been carved from fine lightweight model aircraft plywood.

OPERATION

A multi-disk boomerang is flown in the same manner as a conventional boomerang. The aerodynamics, however, are much different. When held by a control disk/ear 12 or 36 and thrown so at to rotate through the air, all disks having a circular or elliptical airfoil, provide separate and combined lift throughout 360° of rotation. The smaller control disks 12 or 36 orbit the larger main disk 10 and control the flight path. As rotation progresses any angle of dihedral 26 becomes new angle of attack 28; therefore, lift is continuous and more uniformly distributed. As a result, boomerang remains balanced and stable as rotational speed slows.

CONCLUSION, RAMIFICATIONS, AND SCOPE

Thus, the reader will see that my multi-disk boomerang, is most unique. It can be safely and easily flown by anyone old enough to throw it. Variations on the same principle are possible. For example, disks can be altered within limits described so long as the airfoil remains generally circular, and a variety of faces and other decorations can be applied, making it a decorative wall hanging.

While the above description contains certain specificities, these should not be construed as limitations on the scope of the invention but rather as an exemplification of preferred embodiments thereof.

Accordingly, the scope of the invention should be determined not by embodiments illustrated, but by the appended claims and their legal equivalents.

I claim:

1. A homogeneous, one-piece boomerang utilizing circular airfoils in the form of disks comprising:

a. a main disk with two control disks affixed to its perimeter at their perimeters, spaced approximately 100° apart and lying in a generally common plane;

b. said main disk having a diameter approximately one-third greater than the diameters of each said control disk;

c. said main disk and said control disks being essentially round and having a predetermined thickness and being convex across their front surfaces forming three distinct essentially circular airfoils.

2. A homogeneous, one-piece boomerang utilizing circular and elliptical airfoils in the form of disks comprising:

a. an essentially round main disk with two essentially elliptical control disks affixed to its perimeter at their perimeters, extending lengthwise outward from edge of said main disk, space approximately 100° apart and lying in a generally common plane;

b. length of each said elliptical control disk being approximately 150% of the width of same;

c. surface area of said main disk being approximately equal to the combined surface area of said elliptical control disks;

d. said main disk and said control disks having a predetermined thickness and being convex across their front surfaces forming three distinct airfoils.

3. A homogeneous, one-piece boomerang utilizing circular airfoils in the form of disks comprising:

a. a main disk with three control disks equally spaced about its perimeter and affixed thereto and lying in a generally common plane;

b. said main disk having a diameter approximately one-third greater than the diameters of each said control disk;

c. said main disk and said control disks being essentially round and having a predetermined thickness and being convex across their front surfaces forming four distinct, essentially circular, airfoils.

* * * * *